US009398780B1

(12) United States Patent
Matallana

(10) Patent No.: US 9,398,780 B1
(45) Date of Patent: Jul. 26, 2016

(54) SHOWER CAP

(71) Applicant: Zuly Matallana, Toronto (CA)

(72) Inventor: Zuly Matallana, Toronto (CA)

( * ) Notice: Subject to any disclaimer, the term of this patent is extended or adjusted under 35 U.S.C. 154(b) by 0 days.

(21) Appl. No.: 14/835,191

(22) Filed: Aug. 25, 2015

(51) Int. Cl.
*A42B 1/12* (2006.01)

(52) U.S. Cl.
CPC ..... *A42B 1/12* (2013.01)

(58) Field of Classification Search
CPC ..... A41D 7/00; A42B 1/12; A42B 1/04; A42B 1/02; A45D 44/12
USPC ..... 2/67, 68, 200.1, 174, 175.1, 175.2
See application file for complete search history.

(56) References Cited

U.S. PATENT DOCUMENTS 1,182,210 A * 5/1916 Rosenbaum ..... A42B 1/247 2/10
1,207,440 A * 12/1916 Raudnitz ..... A42B 1/248 2/195.1
4,378,606 A * 4/1983 Snowden ..... A42B 1/041 2/200.1
6,330,721 B1 * 12/2001 Wallace ..... A42B 1/12 2/174
6,820,283 B2 * 11/2004 Graneto, III ..... A45D 19/14 2/171.2

* cited by examiner

*Primary Examiner* — Tejash Patel
(74) *Attorney, Agent, or Firm* — Sand & Sebolt

(57) ABSTRACT

A shower cap including a piece of fabric formed into a generally hemispherical shape having a peripheral edge and defining a cavity shaped to receive a portion of the user's head therein. The piece of fabric may be formed from two separate pieces of fabric that are secured together. An elastic member is positioned adjacent only part of the peripheral edge of the piece of fabric and a remaining section of the peripheral edge is free of the elastic member. The piece of fabric is shaped to include an annular band that has a wider section positionable adjacent the user's forehead. The elastic member does not extend into this wider section and consequently this section is able to lay flat against the user's forehead. The exterior of the cap is fabricated from waterproof or water-resistant material and a soft, water-absorbent layer may line at least the band of the cap.

21 Claims, 12 Drawing Sheets

Prior Art

Prior Art

Bottom View

SHOWER CAP

BACKGROUND

1. Technical Field

This application relates generally to beauty products and accessories. More particularly this invention relates to waterproof caps that are wearable in a shower or bath. Specifically this invention is directed to a shower cap having an elastic member in the part of the cap's outermost edge that will be located adjacent the back of a user's head; and which further includes a widened band positionable proximate the user's forehead and which includes a soft water-absorbent layer that will contact the skin.

2. Background Information

Most currently known shower caps are one-size-fits-all and will typically include an elastic closure that is provided around the entire bottom edge or rim of the cap. This elastic closure enables a user to stretch the rim of the cap to a size sufficiently large enough to allow the user to put the cap on their head. Once the cap is in place and is released by the user, the elastic closure will return as much as possible to its original, unstretched size. The elastic closure thereby holds the cap in place on the user's head.

Most caps are made from some type of waterproof material such as a plastic or vinyl fabric. This waterproof material tends to stop water from penetrating the cap and wetting the user's head. However, because these caps are one-size-fits-all by design, a larger quantity of fabric is utilized than would typically be required to cover an average head. This, in combination with the use of an elastic closure, tends to cause the fabric to become gathered around the cap's rim. Even though some of this gathered fabric is stretched out when the cap is worn, there will still be some puckering or bunching of the fabric when the cap is on a user's head. This bunched plastic fabric is uncomfortable to wear and tends to leave marks on the user's skin when the cap is finally removed. The puckering or bunching may also cause small gaps to open up between the cap and the user's skin and allow some water to enter under the cap, wetting the user's hair. Additionally, because of the extra volume of fabric in currently known caps, the cap will tend to slide down the user's forehead and towards their eyes. As the cap slips downwardly it keeps requiring adjustment by the user in order to permit them to see. Furthermore, if the cap is not pulled downwardly to a sufficient degree then the elastic closure will tend to slide the cap upwardly as it cannot gain a grip on the user's hair. This tends to result in the user's ears and lower parts of their hair becoming exposed to the water in the shower. All in all, the currently known caps are uncomfortable to wear.

SUMMARY

There is therefore a need in the art for an improved shower cap that tends to be easy to put on, tends to stays in place where it is initially positioned on the head, and which does not tend to leave marks on the forehead and temples when the cap is removed.

The cap in accordance with the present invention includes an elastic member which is provided in only that part of the cap which goes around the back of the user's head. The elastic member in the improved cap therefore only goes around approximately 180 degrees of the bottom edge of the cap. The elastic is secured to the sides of the cap and therefore the front area does not include any elastic and therefore tends not to wrinkle and mark the user's forehead. Additionally, the frontal region, i.e., the region that is positionable adjacent the user's forehead, may be lined with a soft material and this softer more pliable material will not tend to bunch up in the same manner as plastic or vinyl fabric. The frontal region may also be a wider band of fabric that is free of elastic and may include a logo or decorative image thereon. This widened frontal region may enable a user to quickly locate the front of the cap so that they can determine which way to put the cap onto their head.

In one aspect, a shower cap may comprise a piece of fabric formed to have a generally hemispherical shape; said piece of fabric having a peripheral edge, said piece of fabric bounding and defining a cavity adapted to receive a portion of the user's head therein; and an elastic member; said elastic member being positioned adjacent only part of the peripheral edge of piece of fabric; and wherein a remaining section of the peripheral edge is free of the elastic member.

In another aspect, a shower cap may comprise a first piece of fabric having a peripheral edge; a second piece of fabric having an interior peripheral edge and an exterior peripheral edge; wherein said interior peripheral edge of the second piece of fabric is secured to the peripheral edge of the first piece of fabric; an elastic member secured to the second piece of fabric; wherein the elastic member is positioned inwardly of the exterior peripheral edge and does not extend along all of the exterior peripheral edge of the second piece of fabric; and wherein the first and second pieces of fabric form a generally hemispherical shape which defines a cavity that is adapted to receive a portion of the user's head therein; and wherein the second peripheral edge forms a rim of the hemispherical shape.

BRIEF DESCRIPTION OF THE SEVERAL VIEWS OF THE DRAWINGS

A sample embodiment is set forth in the following description, is shown in the drawings and is particularly and distinctly pointed out and set forth in the appended claims.

Similar numbers refer to similar parts throughout the drawings.

DETAILED DESCRIPTION

Figure 1:
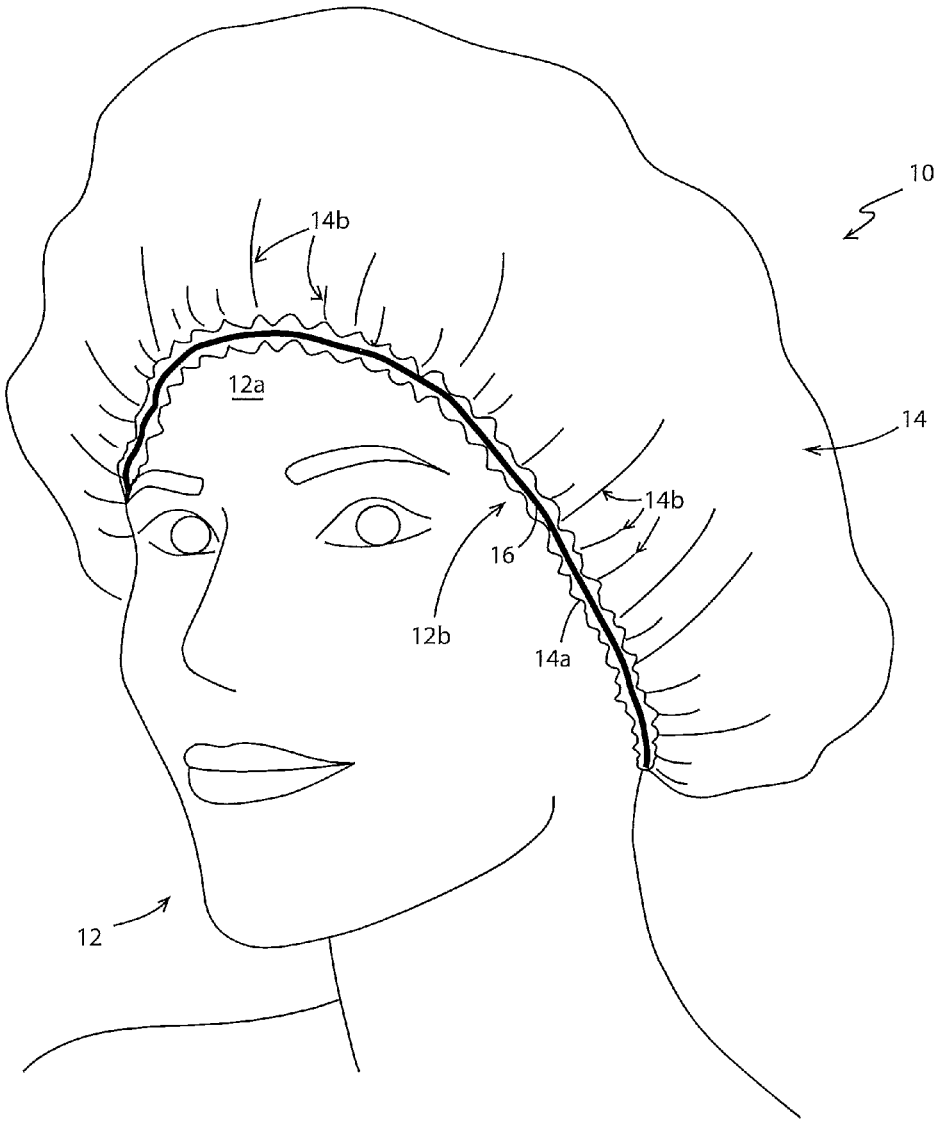
FIG. 1 is a perspective view of a PRIOR ART cap shown on a user's head.
Figure 2:
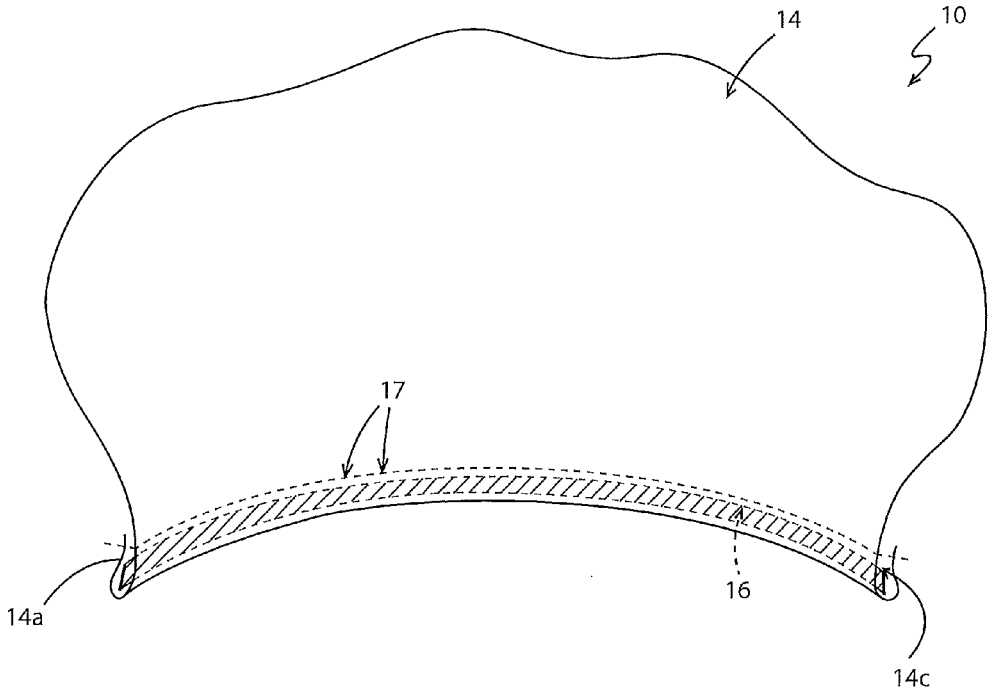
FIG. 2 is a partial cross-section of the PRIOR ART cap showing the construction thereof.

Referring to FIGS. 1 and 2 there is shown a PRIOR ART shower cap generally indicated at 10. Cap 10 is shown on the head 12 of a user. Cap 10 includes a piece of fabric 14, typically a waterproof fabric, which may be generally circular in shape and has an outermost edge 14*a* which is formed into the rim of cap 10. A length of elastic material 16 is secured to fabric 14 proximate outermost edge 14*a* and the ends of the elastic material are joined together so that the elastic material 16 forms a closed loop of 360° and encircles the user's head 12 when cap 10 is worn.

FIG. 1 shows a first method of securing the length of elastic material 16 to the piece of fabric 14. In this first method, the length of elastic material 16 is stitched onto the exterior surface of the piece of fabric 14 a short distance inwardly from outermost edge 14*a*.

FIG. 2 shows a second method of securing the length of the elastic material 16 adjacent outermost edge 14*a*. In this second instance, outermost edge 14*a* is folded back onto itself to form a folded region with a bore 14*c*. The outermost edge 14*a* may be folded back onto the exterior surface of the piece of fabric 14 or may be folded back onto the interior surface of the piece of fabric. The folded material is secured back onto the rest of the fabric 14 by way of stitches 17. The length of elastic material 16 is threaded through bore 14*c* of the folded region and, although not illustrated herein, the two ends of the length of elastic material 16 are secured together so that the elastic material will encircle the user's head when the cap 10 is worn.

In either of the first or second methods discussed above, the length of elastic material 16 utilized is typically shorter than the circumference of outermost edge 14*a* of fabric 14. Consequently, fabric 14 is thrown into a plurality of folds 14*b* when the ends of the length of elastic material 16 are joined together. When cap 10 is placed on user's head 12, the length of elastic material 16 stretches somewhat and consequently some of the folding 14*b* disappears as the fabric 14 is extended over the user's head 12. However, there will typically still be some folding of fabric 14 when cap 12 is worn on the head 12. These folds 14*b* may become bunched up when cap 10 is placed on the user's head 12. The bunched folds 14*b* are particularly problematic on the user's forehead 12*a* and temples 12*b*. When cap 10 is removed after use, the user may tend to have a plurality of "bunch marks" on their forehead 12*a* and temples 12*b*. These marks are left behind by the bunched and folded regions 14*b* of cap 10.

Referring now to FIGS. 3-7, there is shown a first embodiment of an improved shower cap in accordance with an aspect of the present invention. The improved shower cap is generally indicated at 20.

Figure 3:
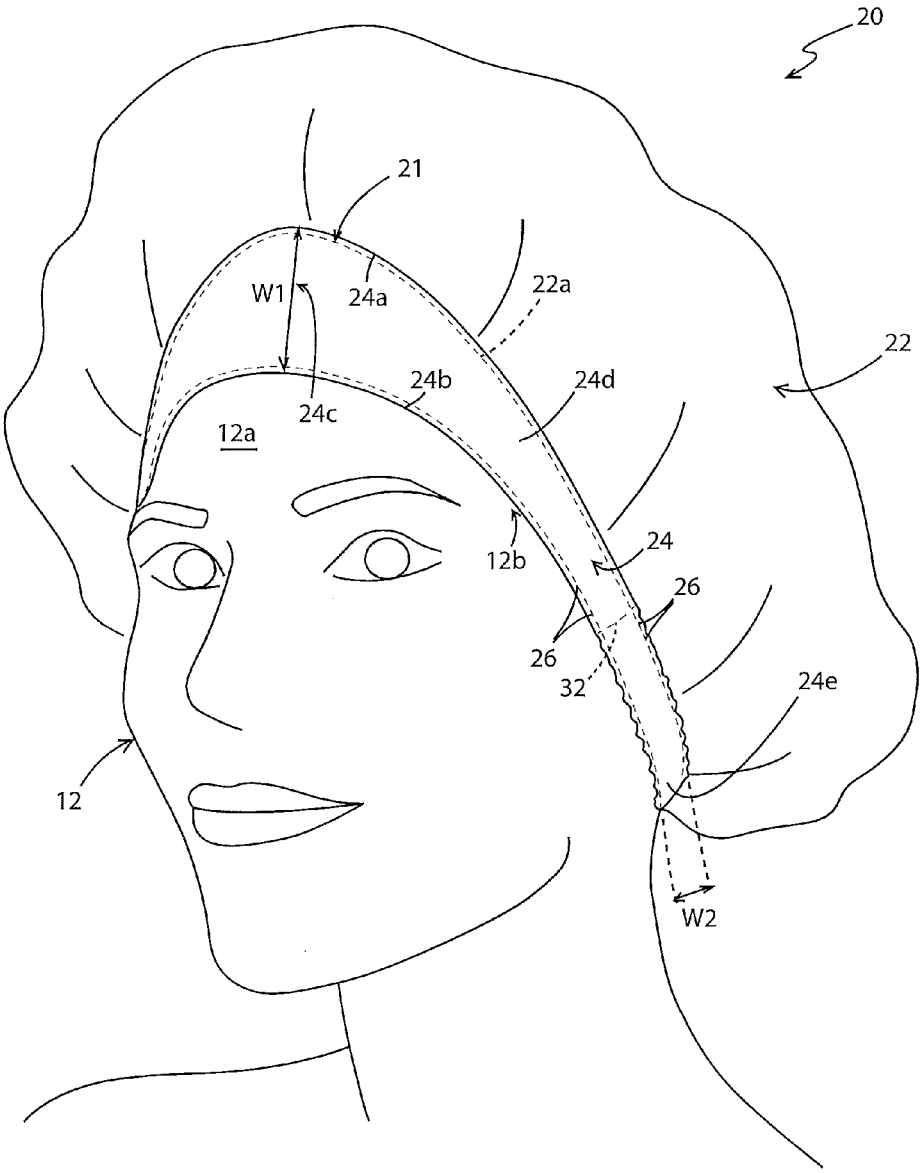
FIG. 3 is a perspective view of a first embodiment of an improved shower cap in accordance with an aspect of the present invention.
Figure 4:
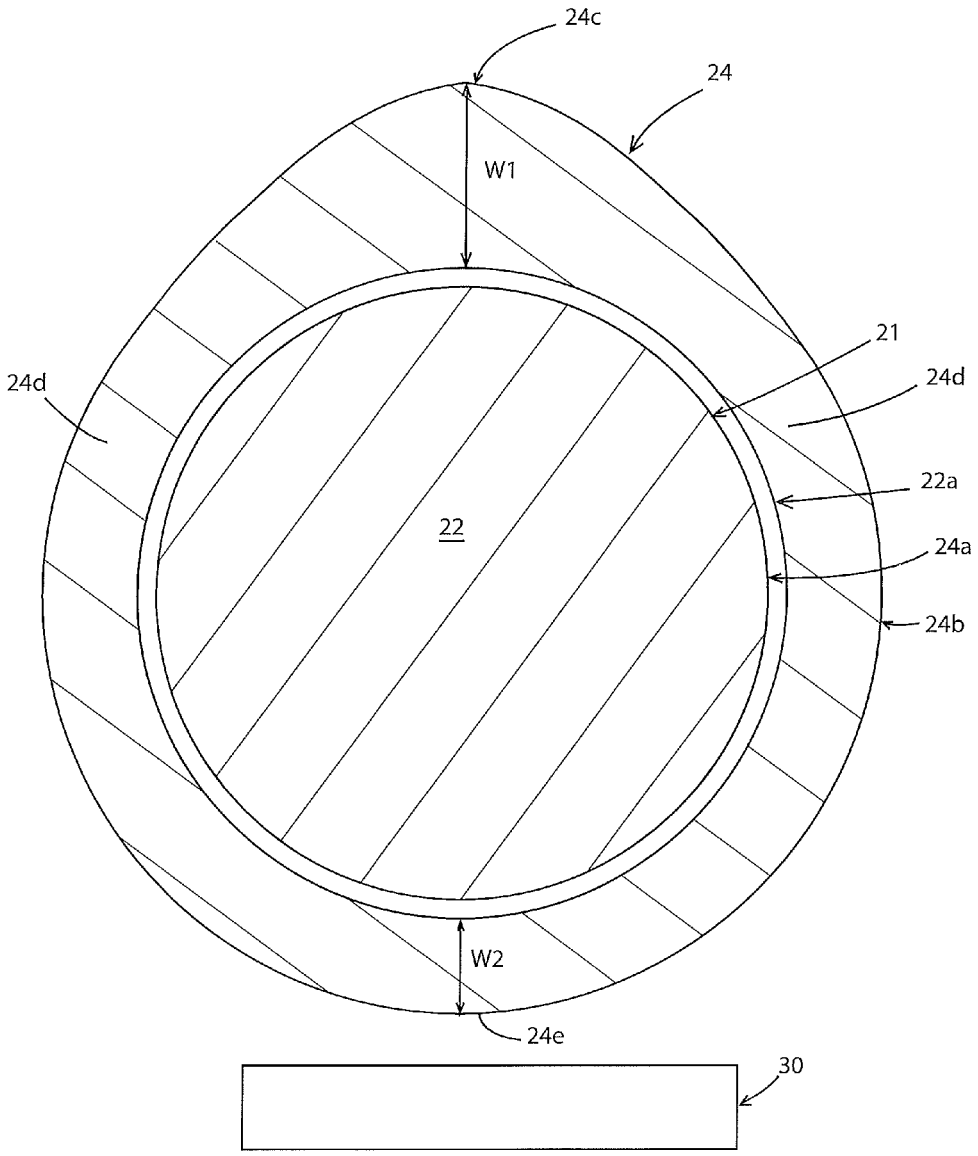
FIG. 4 is a partially exploded top view of the shower cap of FIG. 3.

FIGS. 3 and 4 show that shower cap 20 may be comprised of a first piece 22 and a second piece 24 that are joined together along a seam 21. First piece 22 may be generally circular in shape when viewed from the top (FIG. 4) and have a generally circular peripheral edge 22*a* (i.e., a circumferential edge). Second piece 24 may have an interior peripheral edge 24*a* and an exterior peripheral edge 24*b*. Second piece 24 may be a generally annular ring and interior peripheral edge 24*a* may be an interior circumferential edge and exterior peripheral edge 24*b* may be an exterior circumferential edge. Interior peripheral edge 24*a* may be slightly larger but complementary to the edge 22*a* of first piece 22. Second piece 24 also has an exterior peripheral edge 24*b*. Edges 22*a* and 24*a* are overlapped and sewn together with stitches 26, thus forming seam 21. Edge 24*b* comprises the outermost edge of the fabric used to form cap 20 and thus forms the rim of cap 20.

It will be understood that first piece 22 does not need to be circular and may instead be provided in any of a variety of other suitable shapes for forming a cap, such as being generally oval, elliptical, or square. Second piece 24 will be shaped so that at least the interior edge 24*a* thereof will tend to be complementary to the edge 22*a* of first piece 22. It will further be understood that instead of using a single section of fabric to make up first piece 22 and another single section of fabric to make up second piece 24, more than one section of fabric may be utilized to produce one or both of the first piece 22 and second piece 24. Each of the first piece 22 and second piece 24 may be made up of one or more layers of fabric and these one or more layers may be comprised of the same type of material or may be different types of material. The configurations of first piece 22, second piece 24 are provided as examples of how the principles of the present invention may be incorporated into a shower cap 20.

Figure 5:
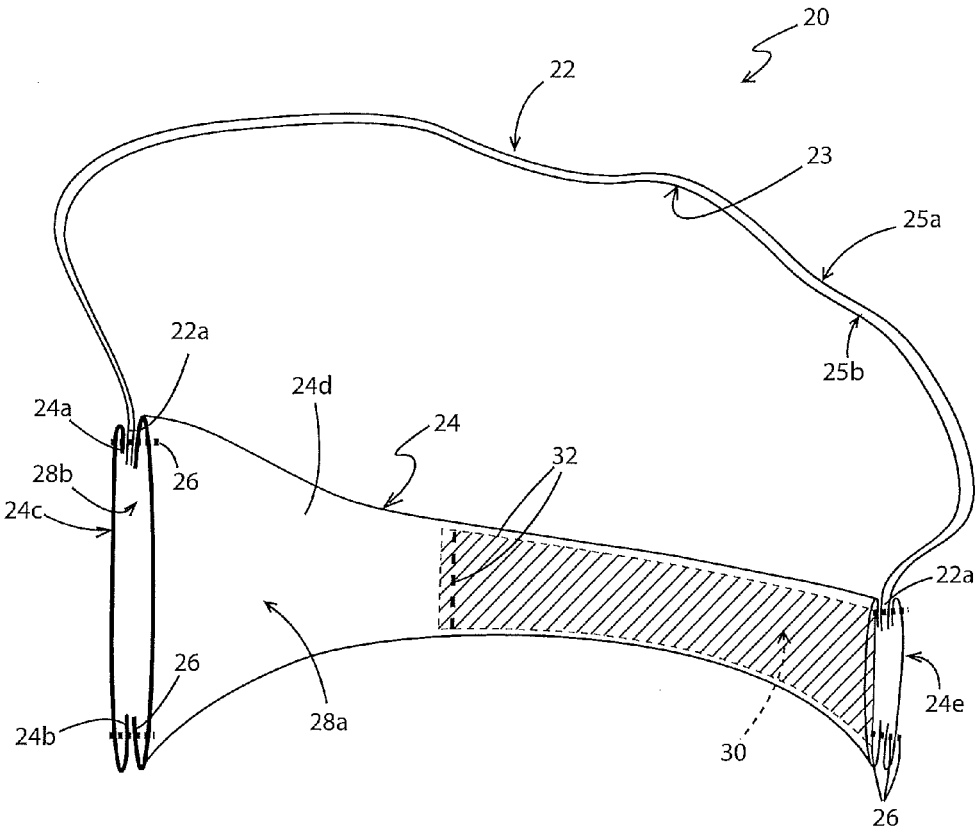
FIG. 5 is cross-section of the shower cap of FIG. 3.

The construction of cap 20 is illustrated in FIG. 5. FIG. 5 shows that first piece 22 is comprised of two layers of fabric, namely, first layer 25*a* and second layer 25*b*. Similarly, second piece 24 is comprised of two layers of fabric, namely inner layer 28*a* and outer layer 28*b*. The edge 22*a* of first piece 22 is thus comprised of the edges of first layer 25*a* and second layer 25*b* that are generally aligned with each other and positioned for securement to second piece 24. Similarly, the edge 24*a* of second piece 24 is comprised of the edges of inner layer 28*a* and outer layer 28*b* that are generally aligned with each other and positioned for secured to first piece 22. FIG. 5 shows that the edges of inner layer 28*a* and outer layer 28*b* are folded inwardly back onto the rest of the associated layer so that the seam 21 on the exterior of cap 20 has a neat and finished appearance. Stitches 26 are used to secure edge 22*a* and edge 24*a* together. Additionally, the outer edges of inner layer 28*a* and outer layer 28*b* are turned inwardly and back on the associated layer, are aligned and then stitched together by stitches 26 to give the rim of cap 20 a finished appearance.

Prior to stitching seam 21 or the rim of cap 20, an elastic member 30 is inserted between inner and outer layers 28*a*, 28*b*. Elastic member 30 is located so that when cap 20 is completed, elastic member 30 will extend for only about 180° along the rim of cap 20. Elastic member 30 is positioned so that it will extend from a region that will be generally aligned with the ears of the user's head 12 and wrap around the back of the user's head 12 when the cap is worn. Elastic member 30 is stitched at either end by stitches 32 and stitches 26 may extend through the side edges of elastic member 30 to hold elastic member 30 in place.

Figure 5A:
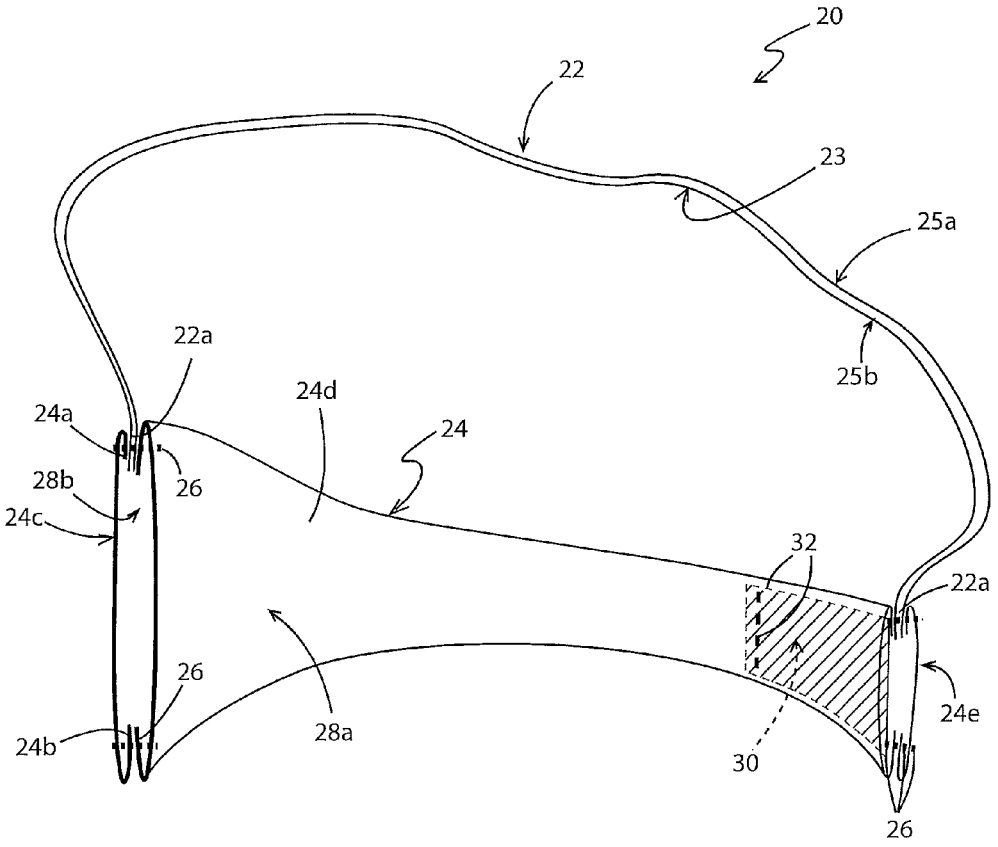
FIG. 5*a* is a cross-section of the shower cap of FIG. 3 where the elastic engaged therewith is of a reduced length.
Figure 6:
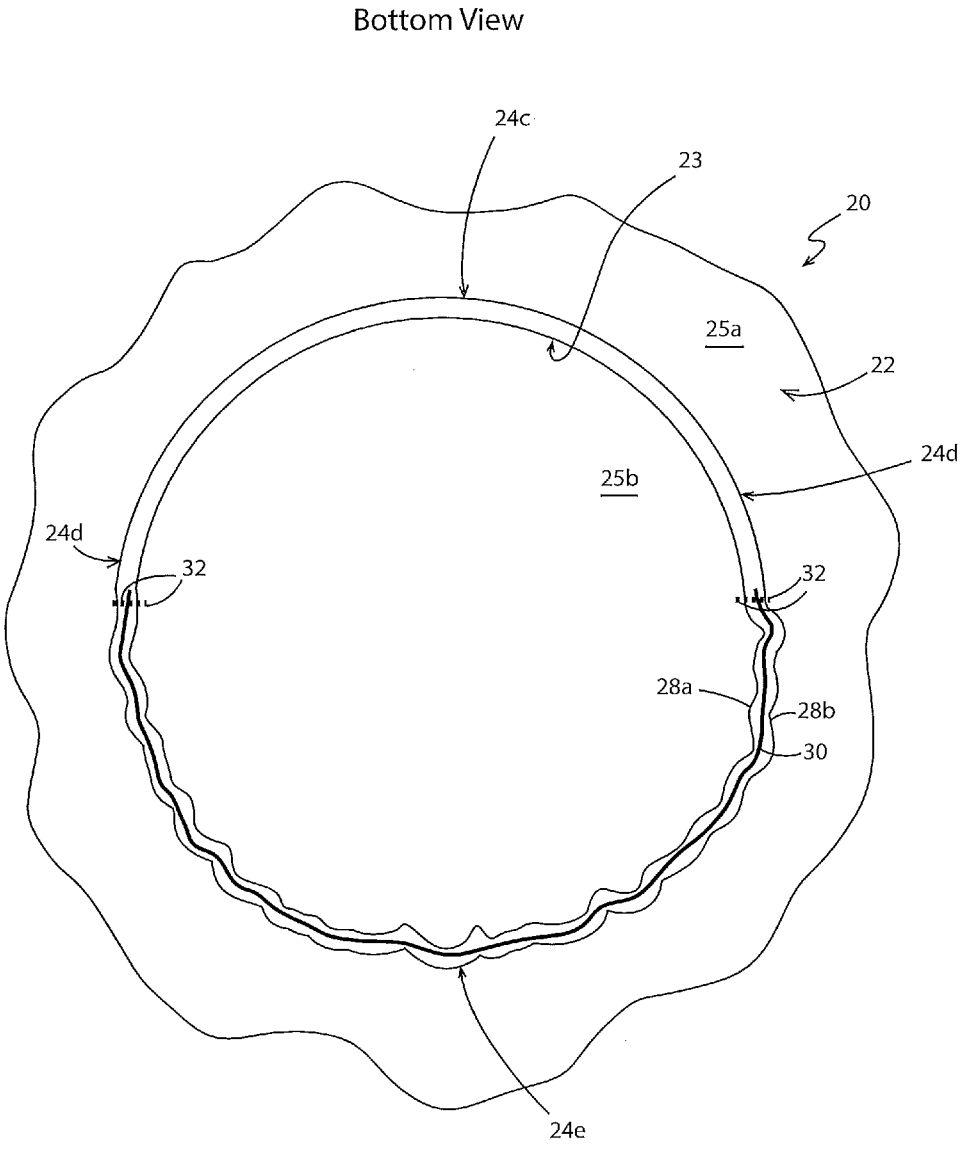
FIG. 6 is a bottom view of the shower cap of FIG. 3.
Figure 6A:
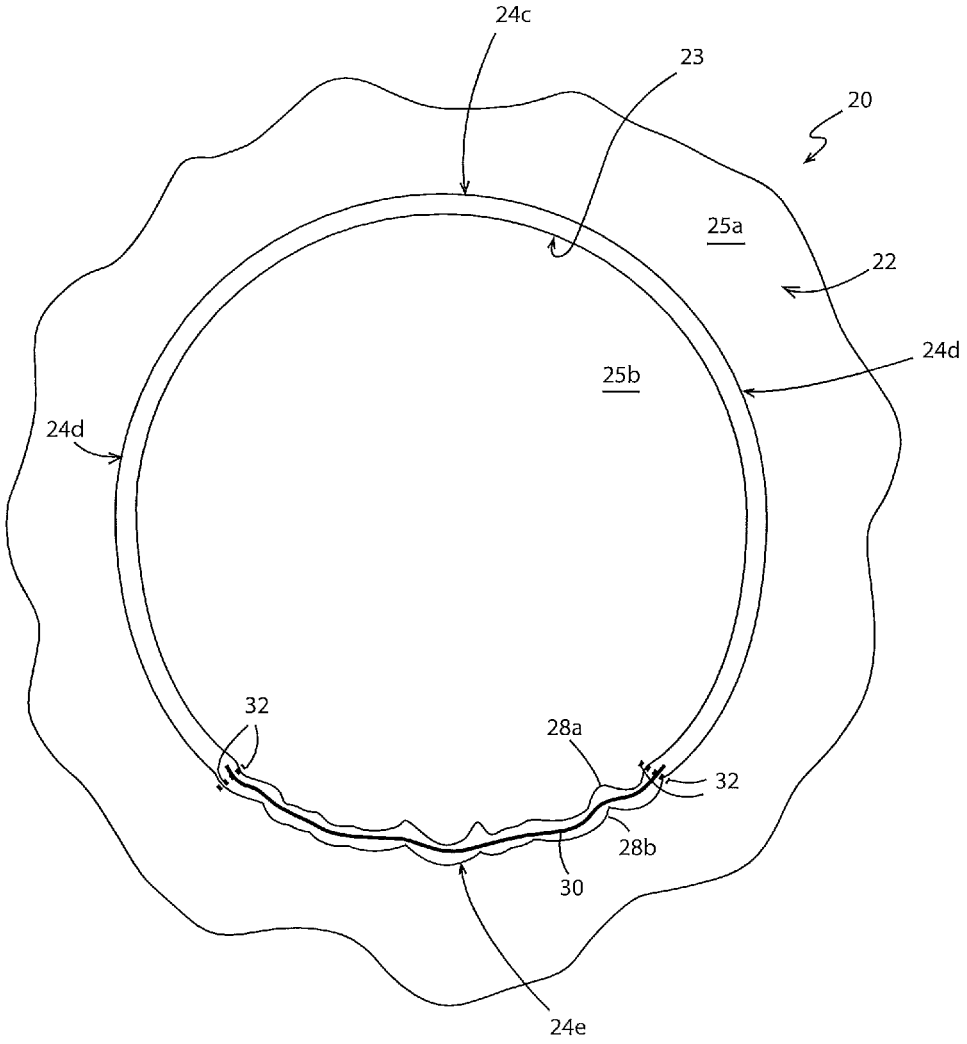
FIG. 6*a* is a bottom view of the shower cap of FIG. 5*a;*

As shown in FIGS. 5*a* and 6*a* the elastic member 30 may be shorter in length than the length of second piece 24 that will extend from adjacent a user's ears and around the back of the user's head 12 illustrated in FIGS. 5 and 6. Consequently, when elastic member 30 is secured to second piece 24, the region of second piece 24 that will pass behind the back of the user's head 12 will tend to become gathered. Since there is no elastic member provided along the remainder of second piece 24, the remainder of second piece 24 will not tend to gather, fold or bunch. Instead, the remainder of second piece 24 will be smooth and generally free of folds. The stitching of the various components together and the provision of elastic member 30 draws cap into a generally hemispherical shape that is illustrated in FIG. 5. First and second pieces 22, 24 bound and define an interior cavity 23 (FIG. 4) that is sized to receive at least an upper portion of the user's head 12 therein. The edge 24*b* of second piece 24 forms the bottom rim of this hemispherical cap.

As indicated above, first piece 22 is comprised of first layer 25*a* and second layer 25*b*. First layer 25*a* may be fabricated from a waterproof or water-resistant material such as nylon. Second layer 25*b* may be fabricated from a soft and water-absorbent material such as terry cloth fabric or toweling. This water-absorbent material may tend to soak up any water that accidentally enters cavity 23 and thus may prevent that water from soaking into the user's hair. Additionally, the soft terry cloth is very comfortable on the skin and therefore makes the cap pleasant to wear.

As further indicated above, second fabric 24 may comprise an annular ring or band of material and this band of material, as illustrated in FIG. 5 may be comprised of inner layer 28*a* and outer layer 28*b*. Inner layer 28*a* may be comprised of a soft, water-absorbent material such as terry cloth and outer layer 28*b* may be comprised of a waterproof or water-resistant fabric such as nylon. As with first piece 22, outer layer 28*b* aids in preventing water to flow into cavity 23 and inner layer 28*a* is gentle on the skin and absorbs water that may accidentally begin to flow into cavity 23.

In accordance with an aspect of the invention, the annular ring or band of material which makes up second piece 24 may have one section that is of a greater width than the remaining part of the band. The width of second piece 24 is measured between interior edge 24*a* and exterior edge 24*b*. The wider section of the annular ring or band of second piece 24 is that region which is designed to rest against the user's forehead 12*a* (FIG. 3). The wider region will be identified herein as the frontal region and be indicated in the drawings by the reference number 24*c*. (It should be noted that this is part of the second piece 24 that is free of any elastic member 30.) The maximum width of frontal region 24*c* is indicated as width "W1" (FIGS. 3 and 4). The minimum width of the remainder of the band is indicated as width "W2". This is the width of that part of second piece 24 which will be located proximate the back of the user's head and be referred to herein as rear region 24*e*. Yet other parts of the band will be located adjacent the user's temples 12*b* and be referred to herein as temporal regions 24*d* of the band. The width of the band tapers as one moves from frontal region 24*c* to temporal regions 24*d*. From temporal regions 24*d* to rear region 24*e*, the band may be of a fairly constant width "W2".

In accordance with another aspect of the invention, frontal region 24*c* may be of an enlarged distinctive shape which enables a user to readily tell which way cap 20 should be placed on their head 12. FIG. 3 shows a "tiara-shaped" frontal region 24*c* which is widest in a central location and tapers toward the temporal regions 24*d*. Frontal region 24*c* may be provided in different shapes including a rectangle, an ellipse, circle, and so on. The enlarged shaped frontal region 24*c* also ensures that there is sufficient contact between the user's forehead 12*a* and cap 20 to seat cap 20 properly on the user's head 12 and stop the same from sliding down into the user's eyes.

FIG. 6 shows a bottom view of cap 20 and illustrates the wrinkled elastic rear region 24*e* and the smooth frontal region 24*c* of second piece 24. FIG. 6 also shows that elastic member 30 covers around 180° of the circumference of cap 20. Elastic member 30 may cover less than 180° and may therefore cover less than half of the circumference of cap 20. This also means that the other 180° or more of the cap's circumference is free of elastic and will therefore tend to lie smoothly against the skin on the user's forehead 12*a* and across their temples 12*b*. The soft inner layer 28*a* is provided for all or most of the 360° circumference of cap 20. At least the frontal region 24*c* of cap 20 is provided with the soft inner layer 28*a*. Furthermore, the frontal region 24*c* and temporal regions 24*d* may be the only parts of second piece 24 that is provided with the soft inner layer 28*a*. The second layer 28*a* helps ensure that the user is comfortable in cap 20 but also serves the additional purpose of ensuring that the rim of cap 20 is provided with a water-absorbent material that will aid in preventing water from penetrating into the interior cavity 23 of cap 20. In some instances the soft inner layer 28*a* may not continue all of the way around to the rear region 24*e* of second piece 24 and will instead only be provided on those portions of the cap that are free of the elastic member 30.

If the soft, water-absorbent material is used for both second layer 25*b* and inner layer 28*a*, then substantially the entire interior cavity 23 will be lined with soft, water-absorbent material. This will tend to make cap 20 far more comfortable than previously known caps. Additionally, substantially the entire exterior surface of cap 20 will be fabricated from waterproof and/or water-resistant material and thus substantially stop water from penetrating therethrough and into cavity 23. However, substantially any water that may penetrate the exterior surface of cap 20 or enter under the rim thereof will be soaked up by the fabric that lines the interior surface thereof.

Figure 7:
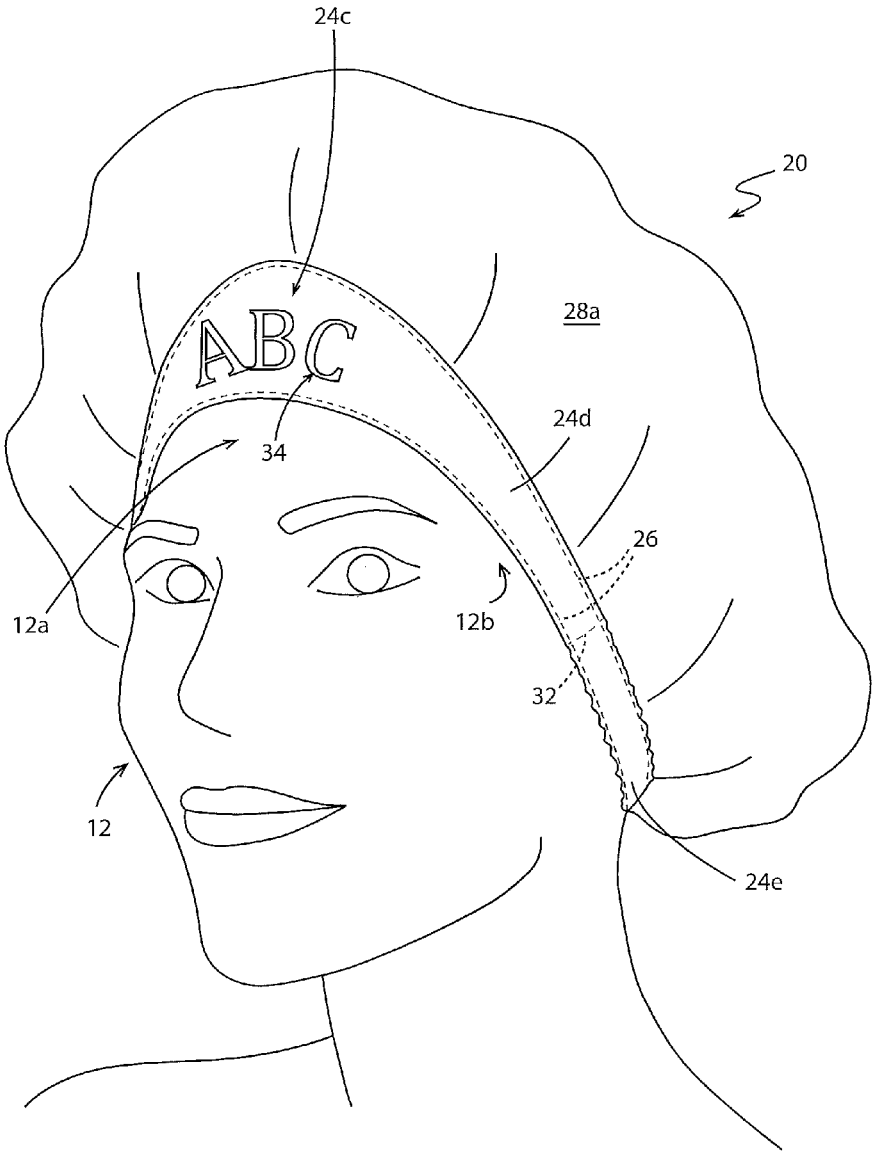
FIG. 7 is perspective view of the improved shower cap of FIG. 3 which includes a logo or decorative image on a frontal region of the cap.

FIG. 7 illustrates that a logo 34 or other decorative image may be provided on frontal region 24*c*. Not only is logo 34 or decorative image useful for branding of cap 20 but logo 34 or the image may also serve as an easy reference for the user to locate frontal region 24*c* so that they know how to orient cap 20 on their head 12. Logo 34 or decorative image may be marked, printed, or embroidered on the second piece 24.

Figure 8:
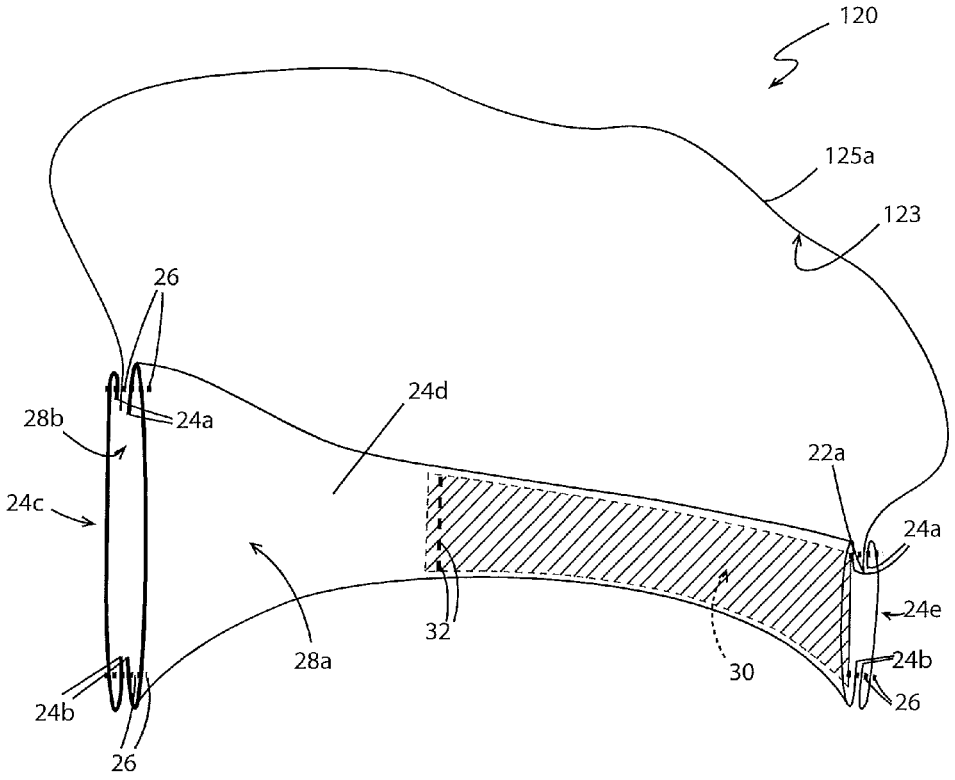
FIG. 8 is a cross-section of a second embodiment of the improved shower cap shown in FIG. 3.

FIG. 8 shows a cross-section of a second embodiment of the improved shower cap. This second embodiment of the cap is generally indicated herein by the reference number 120. Cap 120 is substantially identical in structure and function to cap 20 except that the soft absorbent second layer 25*b* of cap 20 is omitted. Thus, the first piece 122 of fabric utilized in cap 120 is only a single layer 125 and this single layer 125 may be a waterproof or water-resistant material such as nylon. Single layer 125 defines a cavity 123 therein and into which the user's head 12 is receivable. Cap 120 includes the same construction for second piece 24 that is secured to first piece 122.

Figure 9:
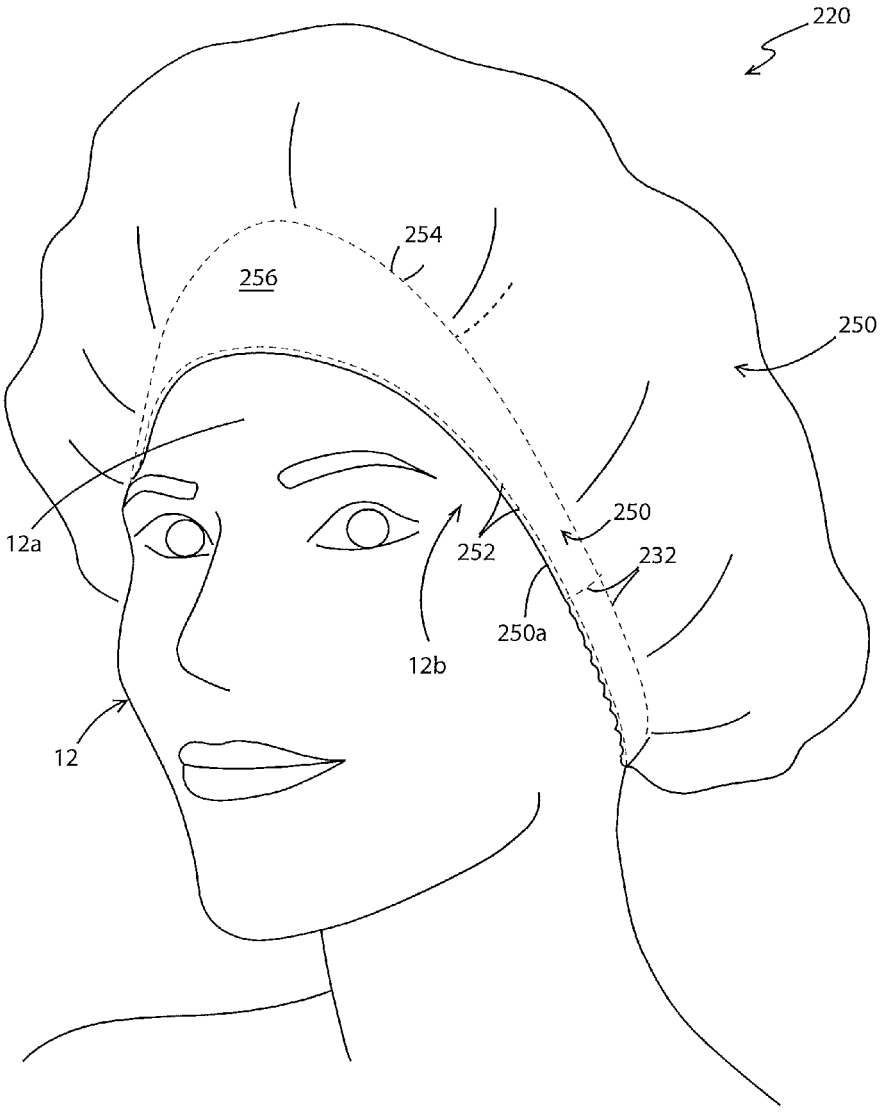
FIG. 9 is a perspective view of a third embodiment of an improved shower cap in accordance with an aspect of the present invention.
Figure 10:
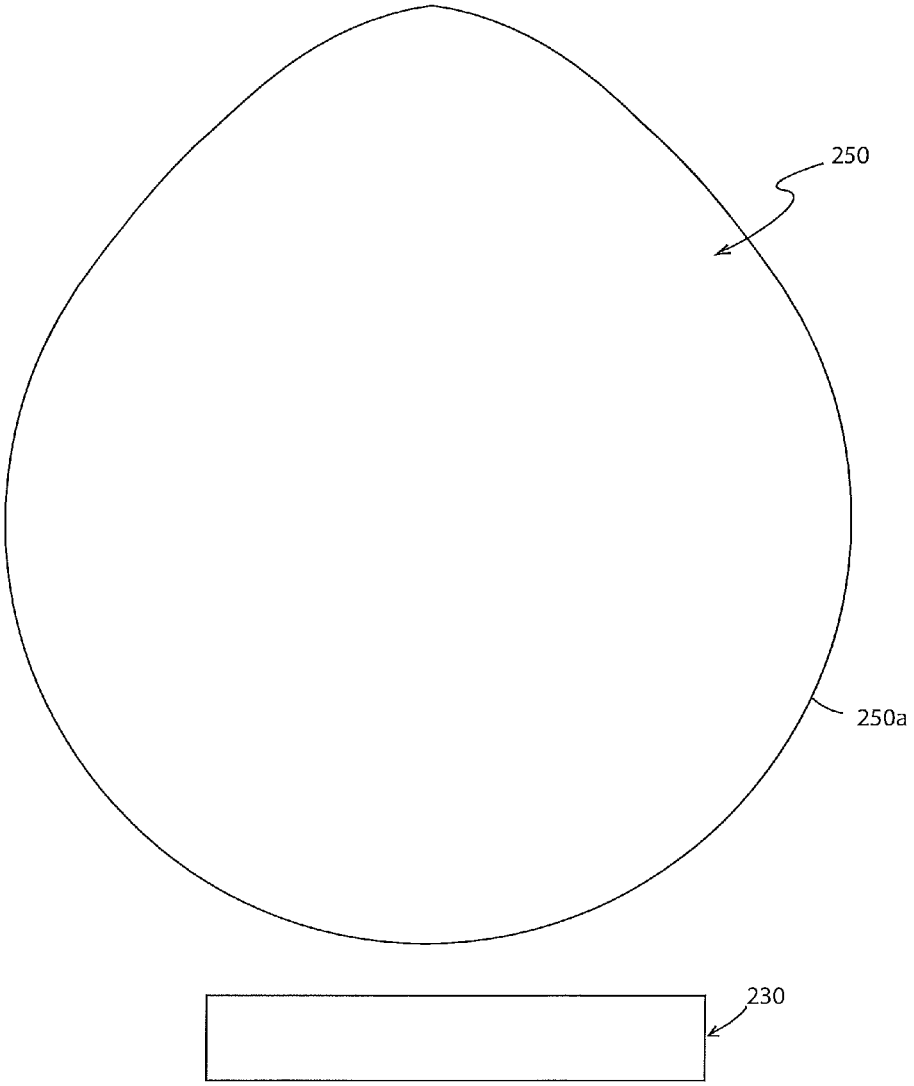
FIG. 10 is an exploded top view of the shower cap of FIG. 9.

FIGS. 9 and 10 show a third embodiment of an improved shower cap in accordance with an aspect of the present invention. The third embodiment of the cap is indicated by the reference number 220. In this particular instance, the entire cap 220 is formed from a single piece of fabric that is indicated in herein by the reference number 250. Single piece 250 has a peripheral edge 250*a* that may be folded over and stitched back upon using stitches 252. This is done simply to provide cap 250 with a finished rim. A second line of stitching 254 is formed a spaced distance from the first stitches 252. This creates a band 256 between stitches 252 and 254. The stitching 252, 254 may be placed to form a shape within cap 220 that is similar to that presented by second piece 24 in cap 20. Thus, the stitching may delineate a frontal region similar to frontal region 24*c*, temporal regions similar to temporal regions 24*d*, and a rear region similar to rear region 20*d*. The shaped band 256 provides a visual indicator to the user of which part of the cap 220 should be placed against their forehead 12*a*. A logo or decorative image may also be placed on the frontal region of this shaped band 256.

An elastic member 230 is positioned and sewn by stitching 232 onto an interior surface of single piece 250 in a region that will fall adjacent the back of the user's head when cap 220 is worn. Elastic member 230 is shorter than the section of the interior surface of single piece 250 to which it is secured and thus that section of single piece 250 is gathered up. The securement of elastic member 230 pulls single piece 252 into the hemispherical shape illustrated in FIG. 9. Although not shown in the figures, it will be understood that single piece 250 bounds and defines a cavity similar to cavity 23 of cap 20. Because the elastic member 230 does not extend into the temporal regions and frontal region of shaped band 256, the frontal and temporal regions thereof will lay flat against the user's forehead 12*a* and temples 12*b* in a similar fashion to those parts of cap 20.

It will be understood that single piece 250 may be comprised of one or more layers of material. If the single piece 250 is a single layer, that single layer may be fabricated from a waterproof or water-resistant material and the elastic member 230 may be positioned against the interior surface thereof.

If single piece 250 is comprised of two layers, for instance, a first exterior layer of waterproof or water-resistant material and a second interior layer of soft water-absorbent material, then elastic member 230 may be positioned between these two layers.

While it has been disclosed herein that frontal region 24*c* is wider than the rest of the band formed by second piece 24, it will be understood that frontal region 24*c* may, alternatively, be of generally the same width as the rest of the band. It will also be understood that the soft-water-absorbent inner layer 28*a* may be omitted from band so that band is only comprised of waterproof or water-resistant fabric. Since the frontal region 24*c* is free of any elastic, the waterproof material of frontal region 24*c* will not tend to fold and bunch and will instead lay substantially flat against the user's forehead 12*a*.

While it is disclosed herein that second piece 24 is an annular band that is concentric with first piece 22, it will be understood that second piece may instead comprise an arcuate or a generally semi-circular section of fabric that is secured along part of the peripheral edge of first section 22 to form a semi-circular or arcuate band. This semi-circular or arcuate section may include a shaped region that is wider than the rest of the band and will be positionable along the forehead of the user. In this instance, the elastic member will be secured to the region of the first section 22 that will be positionable adjacent the back of the user's head.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the description and illustration set out herein are an example not limited to the exact details shown or described.

The invention claimed is:

1. A shower cap for wearing on a user's head, said cap comprising:

a piece of fabric formed to have a generally hemispherical shape; said piece of fabric having a peripheral edge, said piece of fabric bounding and defining a cavity adapted to receive a portion of the user's head therein; and an elastic member; said elastic member being positioned adjacent only part of the peripheral edge of the piece of fabric; and wherein a remaining section of the peripheral edge is free of the elastic member; and when the shower cap is worn on the user's head the elastic member pulls substantially the entire elastic-free section of the peripheral edge into direct contact with the user's head and substantially prevents water from entering the cavity.

2. A shower cap for wearing on a user's head, said cap comprising:

a piece of fabric comprised of a first layer of waterproof or water-resistant material; wherein the piece of fabric is formed to have a generally hemispherical shape; said piece of fabric having a peripheral edge, said piece of fabric bounding and defining a cavity adapted to receive a portion of the user's head therein; and an elastic member; said elastic member being positioned adjacent only part of the peripheral edge of the piece of fabric; and wherein a remaining section of the peripheral edge is free of the elastic member; and wherein the piece of fabric is further comprised of a second layer of water-absorbent material and wherein the second layer bounds and defines the cavity.

3. The shower cap as defined in claim 2, wherein the peripheral edge is formed into a closed loop and the elastic member is positioned adjacent about 180 degrees of the closed loop.

4. The shower cap as defined in claim 2, wherein the elastic member is positioned between the first and second layers.

5. The shower cap as defined in claim 1, wherein the piece of fabric includes a peripheral band located inwardly of the peripheral edge, and stitches separate the peripheral band from an interior region of the piece of fabric; and wherein a section of the peripheral band is wider than a remaining section of the peripheral band; and this wider section is adapted to be placed against a user's forehead when the shower cap is worn.

6. The shower cap as defined in claim 5, wherein the elastic member does not extend into the wider section of the peripheral band.

7. A shower cap for wearing on a user's head, said cap comprising:

a first piece of fabric having a peripheral edge;

a second piece of fabric having an interior peripheral edge and an exterior peripheral edge; wherein said interior peripheral edge of the second piece of fabric is secured to the peripheral edge of the first piece of fabric;

an elastic member secured to the second piece of fabric; wherein the elastic member is positioned inwardly of the exterior peripheral edge and does not extend along all of the exterior peripheral edge of the second piece of fabric; and wherein the first and second pieces of fabric form a generally hemispherical shape which defines a cavity that is adapted to receive a portion of the user's head therein; and wherein a second peripheral edge forms a rim of the hemispherical shape.

8. The shower cap as defined in claim 7, wherein the elastic member extends for around 180° of the rim of the cap.

9. The shower cap as defined in claim 8, wherein the elastic member extends for less than half of the rim of the cap.

10. The shower cap as defined in claim 7, wherein the second piece of fabric forms an annular band and the band has a width measured from the interior peripheral edge to the exterior peripheral edge; and wherein a section of the band is of a greater width than a remaining part of the band; and wherein the section is adapted to be positioned adjacent the user's forehead when the cap is worn.

11. The shower cap as defined in claim 10, wherein the wider section of the band is free of any elastic.

12. The shower cap as defined in claim 10, wherein the wider section tapers on each end into the remaining part of the band.

13. The shower cap as defined in claim 10, further comprising a logo or decorative image provided on the wider section of the band.

14. The shower cap as defined in claim 7, wherein the first piece of fabric includes a first layer of waterproof or water-resistant material.

15. The shower cap as defined in claim 14, wherein the first piece of fabric includes a second layer of water-absorbent material; and the second layer is adapted to be positioned adjacent the user's head when the cap is worn.

16. The shower cap as defined in claim 7, wherein the second piece of fabric includes a first layer of waterproof or water-resistant material.

17. The shower cap as defined in claim 16, wherein the second piece of fabric includes a second layer of soft, water-absorbent material that is adapted to contact the user's head when the cap is worn.

18. The shower cap as defined in claim 17, wherein the second layer extends around 360° of the rim of the cap.

19. The shower cap as defined in claim 11, wherein the wider section of the second piece of fabric includes a skin-contacting layer fabricated from a soft, water-absorbent material.

20. The shower cap as defined in claim 17, wherein the elastic member is positioned between the first and second layers.

21. The shower cap as defined in claim 1, wherein substantially the entire peripheral edge contacts the user's head when the shower cap is placed on the user's head and the entire peripheral edge is pulled tightly to the user's head by the elastic member and substantially prevents water from entering into the cavity.

* * * * *